US007243619B2

(12) United States Patent
Graves et al.

(10) Patent No.: US 7,243,619 B2
(45) Date of Patent: Jul. 17, 2007

(54) DUAL PRESSURE RECOVERY BOILER

(75) Inventors: James K. Graves, Rockwell, TX (US); Melvin J. Albrecht, Homeworth, OH (US); Steven R. Osborne, Canal Fulton, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 10/969,125

(22) Filed: Oct. 20, 2004

(65) Prior Publication Data

US 2006/0081199 A1 Apr. 20, 2006

(51) Int. Cl.
*F22B 13/14* (2006.01)

(52) U.S. Cl. ..... 122/479.6; 122/7 R

(58) Field of Classification Search ..... 122/7 R, 122/7 B, 488, 489, 492, 460, 479.6
See application file for complete search history.

(56) References Cited

U.S. PATENT DOCUMENTS 3,135,244 A * 6/1964 Caracristi ..... 122/240.2
3,135,246 A * 6/1964 Kochey, Jr. ..... 122/240.2
4,409,928 A * 10/1983 Tursi et al. ..... 122/406.4
4,576,124 A * 3/1986 Martens et al. ..... 122/406.5
4,693,213 A * 9/1987 Yanai et al. ..... 122/7 R
4,829,938 A * 5/1989 Motai et al. ..... 122/7 R
5,476,071 A * 12/1995 Nishiyama et al. ..... 122/4 D
5,603,803 A 2/1997 Raak
5,660,799 A * 8/1997 Motai et al. ..... 422/112
5,765,509 A * 6/1998 Liebig et al. ..... 122/7 R

* cited by examiner

*Primary Examiner*—Gregory A. Wilson
(74) *Attorney, Agent, or Firm*—Eric Marich; Michael J. Seymour

(57) ABSTRACT

A dual pressure boiler system has a bottom furnace that operates as a low pressure natural circulation steam generating system and a top furnace that operates as a high pressure natural circulation steam generating system. The low pressure natural circulation steam generating system has a low pressure steam drum, a first pump for providing feed water to the low pressure steam drum, and a low pressure superheater fluidly connected to the low pressure steam drum. The high pressure natural circulation steam generating system has a high pressure steam drum, a second pump for providing feed water to the high pressure steam drum, and a high pressure superheater fluidly connected to the high pressure steam drum.

14 Claims, 2 Drawing Sheets

DUAL PRESSURE RECOVERY BOILER

FIELD AND BACKGROUND OF INVENTION

The present invention relates generally to large commercial boilers, and in particular to a new and useful dual pressure boiler which uses a separate low pressure natural circulation steam generating system in the bottom section of the boiler.

A conventional natural circulation boiler system has a single boiler drum, downcomers, supply tubes, furnace wall tubes, riser tubes and steam/water separators inside the drum. Typically, heated feedwater enters the drum via a feedwater distribution system whose task it is to thoroughly mix the feedwater with the saturated water separated from the steam-water mixture supplied to the separators via the riser tubes.

The resulting water mixture (usually subcooled, i.e., below saturation temperature) enters and flows through the downcomers and is distributed via a number of supply tubes to inlet headers of the furnace circuits, e.g. the wall tubes.

Circulation is established through the difference in fluid density between the downcomers and the heated furnace circuits. The fluid velocity in the furnace circuits (tubes) must be sufficient to cool the furnace tubes, typically exposed to combustion gases whose temperature readily reach the ambient flame temperature of the fired fuel.

The steam-water mixture eventually reaches the outlet headers of the furnace circuits, from where this mixture is led to and distributed along a baffle space and from there to the steam/water separators inside the steam drum.

As soon as the heated fluid reaches saturation conditions, steam is beginning to form and the fluid becomes a two-phase mixture. The fluid velocity must be sufficient to maintain nucleate boiling (bubble-type boiling), as this is the regime which generates the highest possible heat conductance, i.e., the best cooling between the fluid and the inside tube wall on the heated side. Insufficient fluid velocity in combination with high heat flux and excessive percentage of steam in the steam-water mixture leads to steam blanketing, equivalent to an insulating-type steam film along the heated, inside tube wall, which causes rapid tube failure. The danger of film boiling increases with increasing boiler pressure. The fluid temperature in the boiling (two-phase) regime is strictly dependent on the local internal pressure and is nearly constant from the point where boiling starts to the point where the saturated water leaves the separators.

The separators separate the saturated water from the saturated steam, usually through centrifugal force generated through either tangential entry of the two-phase fluid into cyclones or through stationary propeller-type devices. The centrifugal action literally "squeezes" the steam out of the steam-water mixture.

The saturated steam leaves the top of the drum through saturated connecting tubes which supply the steam to the superheater where the steam is further heated to the desired final temperature before being sent to a turbine or a process. The saturated water, as stated earlier, leaves the bottom of the separators and mixes with the continuously supplied feedwater.

Low pressure recovery boilers (generally less than 800 psig operating pressure) have been operating for years without significant material or corrosion problems in the bottom furnace. The bottom furnaces of these units have been designed with much lower level of corrosion protection, such as pin studs and refractory, which has been sufficient in combating corrosion for long periods of time.

As the operating pressure of a recovery boiler and the furnace tube metal temperature increases, the corrosion rate increases significantly which has resulted in the need for more exotic corrosion protection in the bottom furnace. However, use of exotic materials has significant disadvantages. Such metals are prone to cracking and require extensive inspection and maintenance efforts.

A full disclosure of steam drums specifically and boilers in general can be found in Steam/Its Generation and Use, $40^{th}$ Ed., Stultz and Kitto, Eds., © 1992 The Babcock & Wilcox Company.

SUMMARY OF INVENTION

The object of the present invention is to provide a dual pressure recovery boiler having a furnace that is divided into two sections—a bottom low pressure furnace and a top high pressure furnace. Since the water tubes in the bottom furnace are more susceptible to corrosion, the bottom furnace operates as a separate low pressure natural circulation steam generating system. In contrast, the top furnace operates as a high pressure natural circulation steam generating system.

In the preferred embodiment each section of the furnace has its own dedicated pump and steam drum. Alternatively, a single pump may be utilized by one of ordinary skill in the art in place of the individual pumps. In the bottom section of the furnace, the pump provides feed water to the steam drum. The steam drum separates the saturated steam from the water and discharges the steam through a piping system that routes the discharged steam to a low pressure superheater for further heating. The superheated steam from the low pressure superheater is then piped to a plant steam header for use as process steam.

In the high pressure section of the furnace, the feed water pump system first pumps the feed water to an economizer. After being heated in the economizer, the feed water is fed to the steam drum and mixed with the saturated liquid that has been separated in the steam drum. The fluid in the drum is circulated through the high pressure furnace and heated to form a steam and water mixture which is fed to the steam drum for separation. The mixture of separated water, in turn, circulates through the upper high pressure furnace tube walls and generating bank and then re-enters the steam drum. Steam is then separated from the water and discharged into the high pressure superheater. After being super heated, the steam is routed to a turbine generator for producing electricity.

The present invention provides a dual pressure recovery boiler having a separate bottom low pressure natural circulation system which generates steam separate from a top section of the boiler.

The present invention also improves the longevity of the corrosion protection in the bottom low pressure section of the boiler by operating at lower temperatures and lower pressures. Further, the present invention improves the efficiency of electricity generation in the top high pressure section of the furnace.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
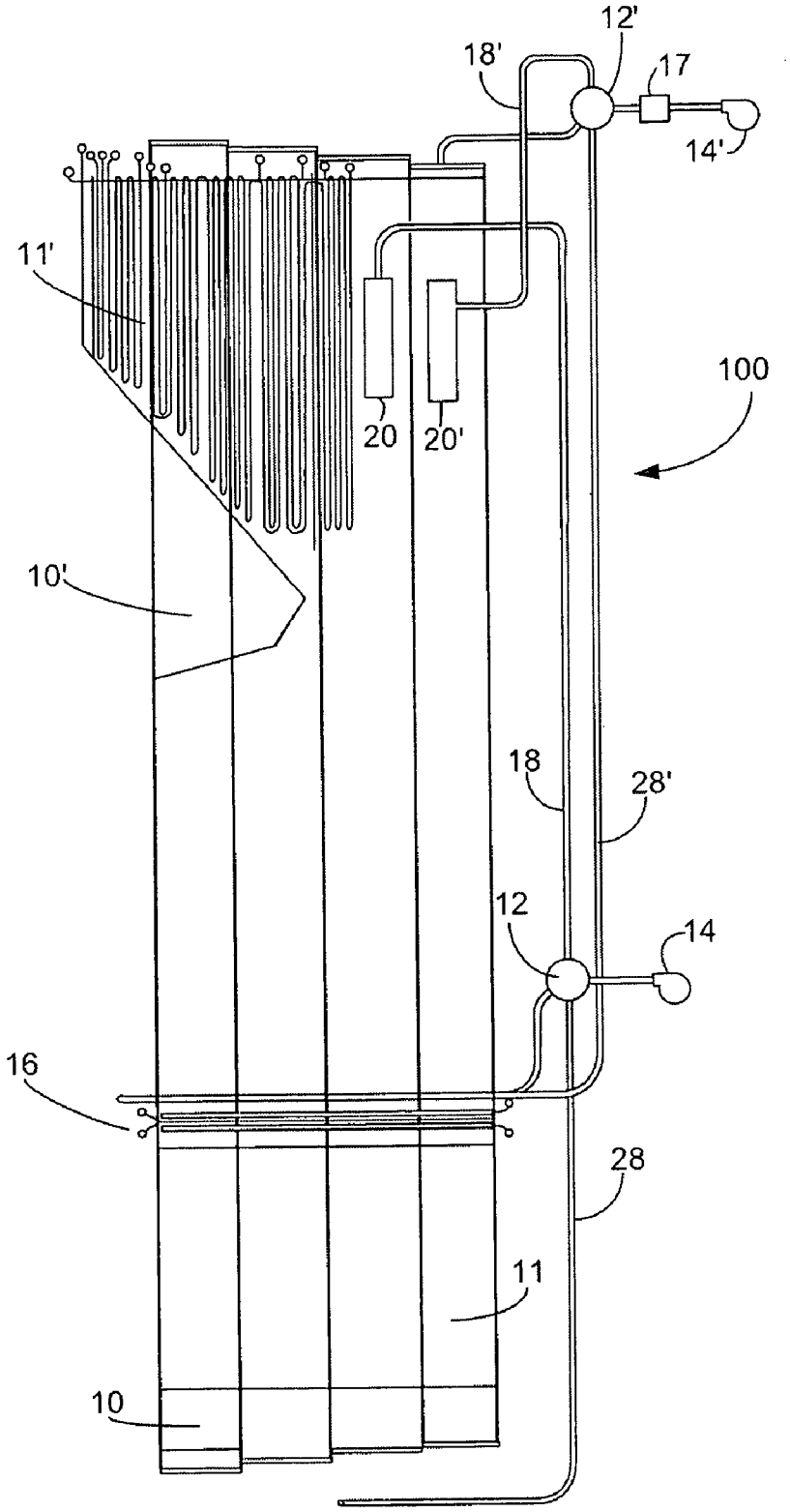
FIG. 1 is a side elevation view of a dual pressure recovery boiler according to the present invention.
Figure 2:
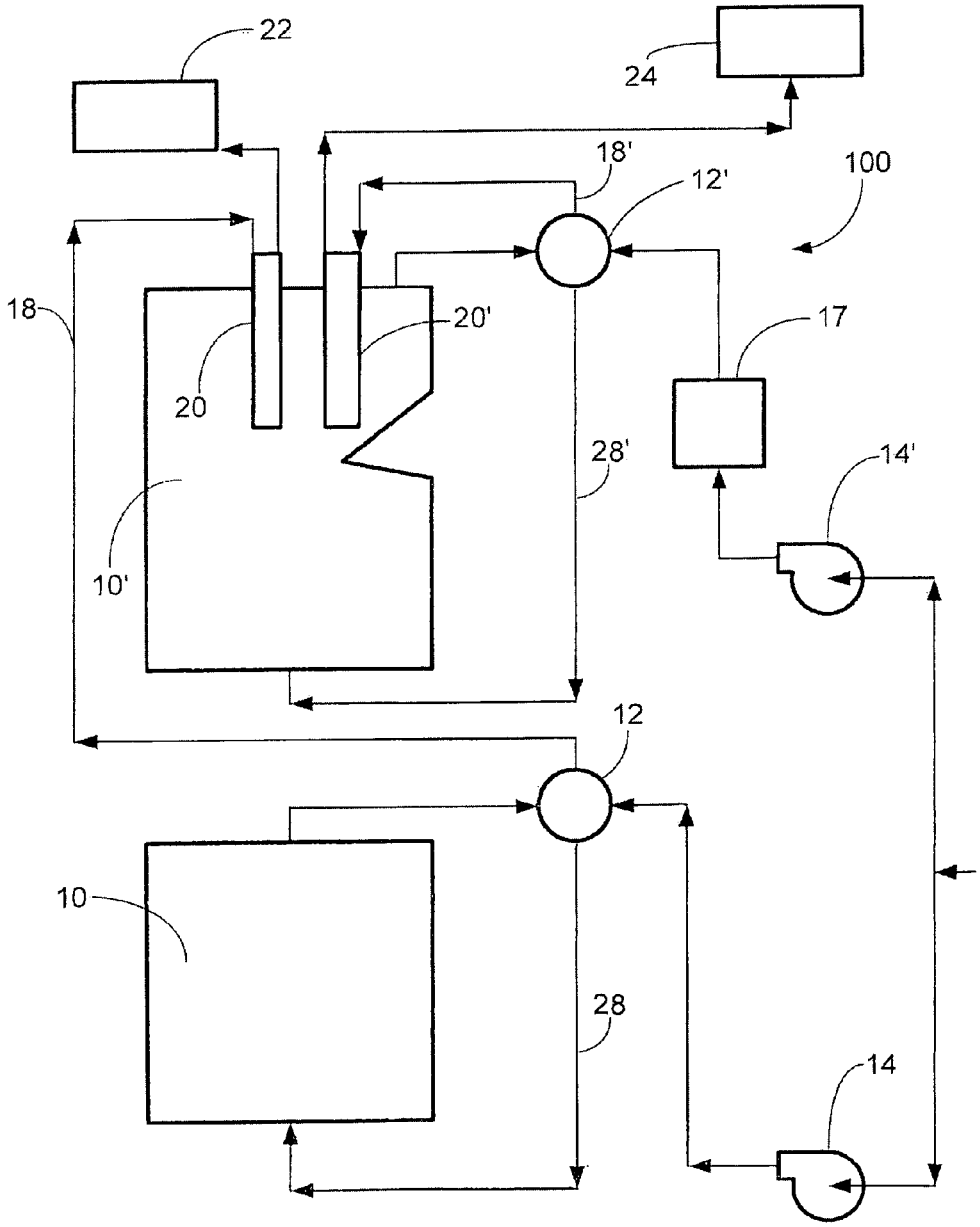
FIG. 2 is a schematic diagram of a dual pressure recovery boiler according to the present invention.

Referring now to the drawings, in which like reference numerals are used to refer to the same or similar elements, FIGS. 1 and 2 show the principle of a dual pressure recovery boiler 100 having a low pressure bottom section 10 and a high pressure top section 10'. The low pressure bottom section 10' is preferably separated from the high pressure top section 10 at approximately six feet above the centerline of tertiary air ports 16.

The low pressure bottom section 10 and the high pressure top section 10' form separate natural circulation systems. Each section 10, 10' has its own dedicated steam drum 12, 12' for separating saturated steam from water, pump 14, 14' for pumping feed water to the steam drum 12, 12', and superheater 20, 20' for increasing the temperature of the saturated steam which exits the steam drum 12, 12'.

Pump 14 feeds water to the lower pressure steam drum 12 preferably at a temperature below the saturation temperature of water in the steam drum. The low pressure steam drum 12 operates at a pressure below eight hundred (800) psig, wherein the preferred range is between about six hundred and fifty (650) psig to about seven hundred and fifty (750) psig. Tubing 18 routes the saturated steam to the low pressure superheater 20 located in the rear of the high pressure top section 10'. The low pressure superheater 20 is a single pass type. The operating pressure of the low pressure steam drum 12 allows for a pressure drop between the drum 12 and the low pressure superheater 20, preferably between about zero (0) psig to about one hundred (100) psig. The low pressure superheater 20 adds between about zero (0) to two hundred (200) degrees Fahrenheit of super heat to the steam, preferably one hundred (100) degrees Fahrenheit, discharging the super heated steam to plant steam header 22 (shown schematically in FIG. 2), between about two hundred (200) psig and about eight hundred (800) psig, preferably about 600 psig. The steam is used for soot blowing or other applications. The operating conditions of the low pressure bottom section 10 of the boiler 100 produce at least one hundred thousand (100,000) pph of saturated steam. However, the amount of saturated steam actually produced may vary depending on the needs of the application and how one of ordinary skill in the art utilized the teachings of the present invention.

The separated water from the low pressure steam drum 12 flows in piping 28 into the low pressure bottom section 10 of the boiler 100. The water enters into and circulates in furnace wall tubes 11 and then re-enters the low pressure steam drum 12. The process of separating saturated steam from the water, discharging the saturated steam to the low pressure superheater 20 and directing the super heated steam to the steam header 22 repeats.

The natural circulation system in the high pressure top section 10' is operated similarly but at higher temperatures and pressures. The pump 14' feeds water to heat exchanger or economizer 17 which is fluidly connected downstream from the pump 14' before the high pressure steam drum 12'. The economizer 17, in turn, discharges the water to the high pressure steam drum 12'. Steam is separated from the circulating water and routed via tubing 18' to the high pressure superheater 20', which is preferably located adjacent the low pressure superheater 20. From the high pressure superheater 20', the steam flows to turbine/generator 24 (shown schematically in FIG. 2) to produce electricity. Water from the steam drum circulates through the upper furnace walls 11' and the generating bank and is redirected to the high pressure steam drum 12'.

While a specific embodiment of the invention has been shown and described in detail to illustrate the application of the principles of the invention, it will be understood that the invention may be embodied otherwise without departing from such principles.

We claim:

1. A dual pressure boiler system comprising:

a bottom furnace that operates as a low pressure natural steam generating system having a low pressure steam drum, a first pump for providing feed water to the low pressure steam drum, and a low pressure superheater fluidly connected to the low pressure steam drum; and a top furnace that operates as a high pressure natural steam generating system having a high pressure steam drum, a second pump for providing feed water to the high pressure steam drum, a high pressure superheater fluidly connected to the high pressure steam drum, and a tertiary air port wherein the bottom furnace is located below the tertiary air port.

2. The dual pressure boiler system as claimed in claim 1, wherein the high pressure natural steam generating system further comprises an economizer fluidly connected downstream from the second pump before the high pressure superheater.

3. The dual pressure boiler system as claimed in claim 1, wherein the low pressure superheater discharges steam to a steam header and the high pressure superheater discharges steam to a turbine generator.

4. The dual pressure boiler system as claimed in claim 1, wherein the high pressure steam drum has an operating pressure in the range of about nine hundred and fifty (950) psig to about twenty four hundred (2400) psig.

5. The dual pressure boiler system as claimed in claim 1, wherein the low pressure superheater is located adjacent to the high pressure superheater at the top of the furnace.

6. The dual pressure boiler system as claimed in claim 1, wherein the low pressure superheater is a single pass type.

7. The dual pressure boiler system as claimed in claim 1, wherein the low pressure steam drum has an operating pressure that allows for a pressure drop between the low pressure steam drum and the low pressure superheater between about zero (0) psig and about one hundred (100) psig.

8. The dual pressure boiler system as claimed in claim 1, wherein the low pressure steam drum has an operating pressure that allows for a pressure drop between the low pressure steam drum and the low pressure superheater of about one hundred (100) psig.

9. The dual pressure boiler system as claimed in claim 1, wherein the low pressure superheater adds between about zero (0) and about two hundred (200) degrees Fahrenheit of super heat to the steam.

10. The dual pressure boiler system as claimed in claim 9, where the top furnace is located above the tertiary air port.

11. The dual pressure boiler system as claimed in claim 9, where the top furnace is located below the tertiary air port.

12. The dual pressure boiler system as claimed in claim 1, wherein the low pressure superheater adds about one hundred (100) degrees Fahrenheit of super heat to the steam.

13. The dual pressure boiler system as claimed in claim 1, wherein the low pressure superheater discharges steam between about 200 and about 800 psig.

14. The dual pressure boiler system as claimed in claim 1, wherein the low pressure superheater discharges steam at about 600 psig.

* * * * *